US009445961B2

(12) United States Patent
Okada

(10) Patent No.: US 9,445,961 B2
(45) Date of Patent: Sep. 20, 2016

(54) TABLE FOR WHEELCHAIR AND WHEELCHAIR COMPRISING SAME

(71) Applicant: Kyokuyou Steel Mechanical Factory Co., LTD., Kagawa (JP)

(72) Inventor: Yoshiyuki Okada, Kagawa (JP)

(73) Assignee: KYOKUYOU STEEL MECHANICAL FACTORY CO., LTD., Kagawa (JP)

( * ) Notice: Subject to any disclaimer, the term of this patent is extended or adjusted under 35 U.S.C. 154(b) by 0 days.

(21) Appl. No.: 14/408,537

(22) PCT Filed: Oct. 9, 2013

(86) PCT No.: PCT/JP2013/077464
§ 371 (c)(1),
(2) Date: Dec. 16, 2014

(87) PCT Pub. No.: WO2014/057972
PCT Pub. Date: Apr. 17, 2014

(65) Prior Publication Data

US 2015/0157517 A1 Jun. 11, 2015

(30) Foreign Application Priority Data

| | | |
|---|---|---|
| Oct. 12, 2012 | (JP) | 2012-239587 |
| Dec. 10, 2012 | (JP) | 2012-288847 |
| May 16, 2013 | (JP) | 2013-118287 |
| Aug. 7, 2013 | (JP) | 2013-174989 |

(51) Int. Cl.
*A47B 83/00* (2006.01)
*A61G 5/10* (2006.01)
*A47C 7/70* (2006.01)

(52) U.S. Cl.
CPC . *A61G 5/10* (2013.01); *A47C 7/70* (2013.01); *A47B 2200/13* (2013.01); *A61G 2005/1094* (2013.01)

(58) Field of Classification Search
CPC .. A61G 5/10; A61G 2005/1094; A47C 7/70; A47B 83/02; A47B 3/14; A47B 39/00
USPC ..... 297/173, 162; 108/42, 44, 134, 135; 248/231.71, 230.3, 292.12; 16/327, 16/332, 334, 349; 403/93, 96
See application file for complete search history.

(56) References Cited

U.S. PATENT DOCUMENTS 2,498,736 A * 2/1950 Freund ..... A47C 21/00 297/149
2,604,140 A * 7/1952 Bursey ..... A61G 5/00 297/328

(Continued)

FOREIGN PATENT DOCUMENTS

JP H09108274 A 4/1997
JP H1176311 A 3/1999

(Continued)

OTHER PUBLICATIONS

International Search Report PCT/ISA/210 for international Application No. PCT/JP2013/077464 Dated Nov. 19, 2013.

*Primary Examiner* — Janet M Wilkens
(74) *Attorney, Agent, or Firm* — Harness, Dickey & Pierce, P.L.C.

(57) ABSTRACT

A wheelchair table includes: an attachment part configured to be attached to a side part of a wheelchair; an arm supported by the attachment part; and a table body provided at a tip part of the arm. The arm is supported so as to be movable upward and downward relative to the attachment part such that the table body can be lowered from an in-use position located above a user's knees to a not in-use position located in front of and below the knees while the user sits in the wheelchair. With this wheelchair table, operability and safety during wheelchair travel can be enhanced while favorably maintaining the function as a table.

7 Claims, 17 Drawing Sheets

(56) References Cited

U.S. PATENT DOCUMENTS 3,142,511 A 7/1964 Rehel
3,606,450 A * 9/1971 Sedgwick ..... A47C 7/68 108/129
4,540,306 A * 9/1985 Wang ..... E06C 1/32 16/332
4,543,006 A * 9/1985 Wang ..... E06C 1/32 16/332
4,566,732 A * 1/1986 Ostergaard, II ..... A47B 23/02 108/8
4,577,986 A * 3/1986 Wang ..... E06C 1/32 16/325
4,779,884 A * 10/1988 Minati ..... A47C 7/70 280/304.1
4,824,278 A * 4/1989 Chang ..... E06C 1/32 16/332
5,022,118 A * 6/1991 Wan-Li ..... E06C 1/32 16/327
5,035,464 A * 7/1991 Spallholtz ..... A47C 7/62 297/144
5,293,826 A * 3/1994 Perez ..... A47B 23/025 108/134
5,413,400 A * 5/1995 Llanes ..... A47C 4/10 297/154
5,564,779 A * 10/1996 Tolbert ..... A47C 7/70 297/144
5,653,499 A * 8/1997 Goodall ..... A47C 7/70 297/170
5,673,628 A * 10/1997 Boos ..... B60N 3/001 108/138
5,893,607 A * 4/1999 Trimnell ..... A47C 7/70 108/27
7,900,566 B1 * 3/2011 Bunker ..... A47C 7/68 108/167
8,020,829 B1 * 9/2011 Tamayori ..... F16M 11/14 108/144.11
2006/0032417 A1 2/2006 Goschy et al.
2008/0302938 A1 * 12/2008 Goodwin ..... A61G 5/10 248/288.51

FOREIGN PATENT DOCUMENTS

JP 2000333740 * 12/2000
JP 2001017474 A 1/2001
JP 3158615 B2 4/2001
JP 2003126164 A 5/2003
JP 4193107 B2 12/2008

* cited by examiner

TABLE FOR WHEELCHAIR AND WHEELCHAIR COMPRISING SAME

TECHNICAL FIELD

The present invention relates to a wheelchair table and a wheelchair provided therewith.

BACKGROUND ART

As for conventional wheelchair tables, for example, configurations disclosed in Patent Literatures 1 and 2 are known. The wheelchair table of Patent Literature 1 is placed on both arm rests of the wheelchair and fixed by a fixing belt. According to this configuration, the wheelchair table needs to be removed from the wheelchair when the table is not used, and thus there is a problem in that storage of the wheelchair table is likely to be troublesome. On the other hand, if the wheelchair is moved around with the wheelchair table in place, the wheelchair table is likely to get in the way during moving, and furthermore, a view around the feet is blocked by the wheelchair table, and thus there is also a safety problem.

In contrast, with the wheelchair table of Patent Literature 2, a table body supported by a table support rod is rotated and lowered when the table body is not used so that the table body is retracted together with the table support rod, and thereby the table body can be stowed away without being removed.

CITATION LIST

Patent Literature

[PTL 1] JP-A H11-76311
[PTL 2] JP-A 2003-126164

SUMMARY OF INVENTION

Technical Problem

However, according to the configuration of Patent Literature 2, the table body when not in use is positioned below the armrest, and thus there is a problem in that the table body is likely to impede wheelchair operation. Moreover, formation of storage space for portable items results in an increased table body size and thus an increased wheelchair width, and is problematic in that, in addition to further deteriorating operability, moving through a narrow passage or the like is likely to be troublesome.

Accordingly, an object of the present invention is to provide a wheelchair table that can enhance operability and safety during wheelchair travel while favorably maintaining the function as a table, and a wheelchair provided therewith.

Solution to Problem

The aforementioned object of the present invention is achieved by a wheelchair table comprising an attachment part to be attached to a side part of a wheelchair, an arm supported by the attachment part, and a table body provided at a tip part of the arm, wherein the arm is supported so as to be movable upward and downward relative to the attachment part such that the table body can be lowered from an in-use position located above a user's knees to a not in-use position located in front of and below the knees while the user sits in the wheelchair.

It is preferable that in this wheelchair table the arm is supported so as to be rotatable in upward and downward directions relative to the attachment part. Furthermore, the arm can comprise a latch part capable of engagement with an engagement part of the attachment part, a spring for biasing the latch part so as to engage with the engagement part, and a lever for detaching the latch part against a biasing force of the spring, and the arm can be rotatable relative to the attachment part when the user pushes the lever while sitting in the wheelchair to cancel the engagement of the engagement part and the latch part.

The direction in which the lever is pushed for cancelling the engagement of the engagement part and the latch part can be configured to match the rotational direction of the arm.

It is preferable that the arm comprises a framework for rotatably supporting the lever, and it is preferable that the lever comprises a handle placed within the framework.

It is preferable that the wheelchair table further comprises a cushioning mechanism that eases a rapid rotational movement of the arm relative to the attachment part.

It is preferable that the in-use position of the table body comprises a first in-use position in which an upper surface of the first table body is level and a second in-use position in which the upper surface of the first table body is tilted toward the user's side.

It is preferable that the table body is rotatably attached to the arm, and it is preferable that the table body can be retracted to a side from above the knees or from in front of and below the knees of the user.

It is preferable that the table body comprises a base part supported by the arm and a receptacle that is attachable to and detachable from the base part, and it is preferable that the receptacle, once removed from the base part, is capable of being carried.

The aforementioned object of the present invention is achieved by a wheelchair in which the above-described wheelchair table is attached to a side part.

Advantageous Effects of Invention

The present invention can provide a wheelchair table that can enhance operability and safety during wheelchair travel while favorably maintaining the function as a table, and a wheelchair provided therewith.

DESCRIPTION OF EMBODIMENTS

Figure 1:
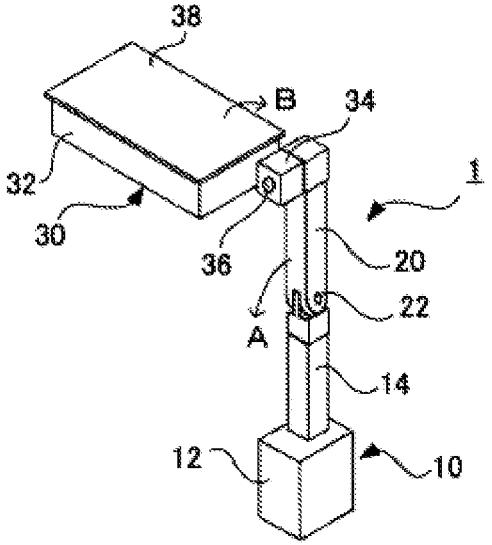
FIG. 1 is a perspective view of a wheelchair table according to a first embodiment of the present invention.

Below, an embodiment of the present invention will now be described with reference to the attached drawings. FIG. 1 is a perspective view of a wheelchair table according to the first embodiment of the present invention. A wheelchair table 1 comprises an attachment part 10 to be attached to a wheelchair, an arm 20 supported by the attachment part 10, and a table body 30 provided on the arm 20.

The attachment part 10 comprises an main body 12 having a holding part (not shown) on the back surface side for holding onto, for example, the frame of a wheelchair in a clamping manner, and a retaining part 14 extending upward from the main body 12. The proximal end part of the arm 20 is rotatably attached by a rotating shaft 22 to the tip part of the retaining part 14. It is preferable that the attachment part 10 can be detachably fixed to a wheelchair such that the arm 20 can be erected in the vertical direction, and a suitable means other than the holding part can be used, such as attachment by a belt, screwing, and interlocking. Note that the attachment part 10 can also be integrated into a wheelchair so as to be undetachable therefrom by welding or the like. The rotating shaft 22 is fixed stepwise by a ratchet mechanism (not shown) and can retain the arm 20 at the desired rotational position.

The table body 30 comprises a mounting part 34 on the side wall of a casing 32 that has storage space inside, and the mounting part 34 is rotatably attached by a rotating shaft 36 to the tip part of the arm 20. The rotating shaft 36 is fixed stepwise by a ratchet mechanism (not shown) and can retain the table body 30 at the desired rotational position. The upper opening of the casing 32 is closed by a lid 38 that can be opened and closed in a slidable manner. It is preferable that the rotational direction of the arm 20 relative to the attachment part 10 (the direction indicated by arrow A) and the rotational direction of the table body 30 relative to the arm 20 (the direction indicated by arrow B) are different from each other, and in this embodiment, imaginary planes including the respective rotational directions are configured to be perpendicular to each other. The material of the table body 30 is not particularly limited as long as necessary strength can be secured, and examples include iron, stainless steel, aluminum, plastics, carbon, ceramics, wood, and the like. If the storage space in the table body 30 is not needed, the table body 30 can be configured to correspond only to the lid 38 to save weight.

Figure 2:
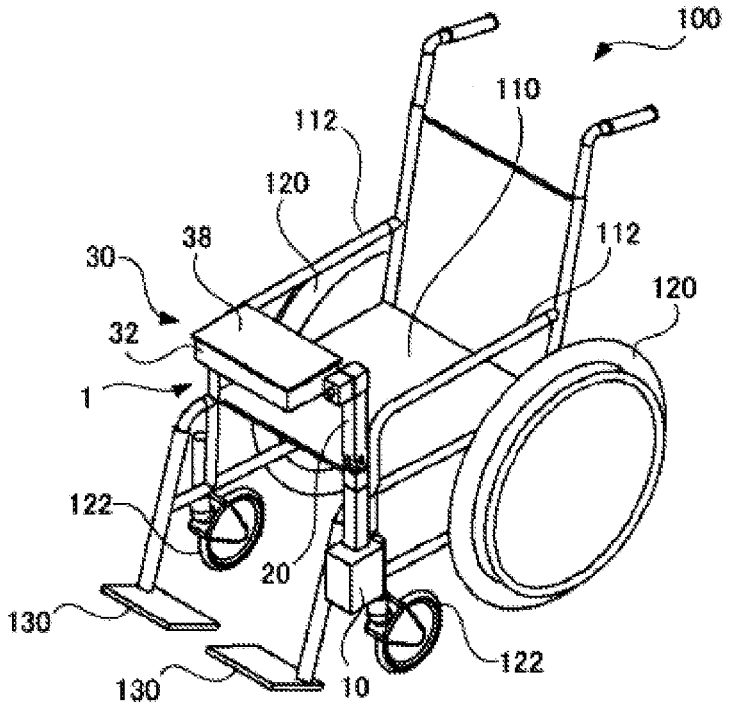
FIG. 2 is a perspective view showing a state in which the wheelchair table shown in FIG. 1 is attached to a wheelchair.

FIG. 2 is a perspective view showing a state in which the wheelchair table 1 shown in FIG. 1 is attached to a wheelchair 100. The wheelchair 100 comprises frames 112 and 112 on both right and left sides of a seat 110 on which a user sits, and driving wheels 120 and 120 and small wheels 122 and 122 on the outer sides of the frames 112 and 112. Footrests 130 and 130 are provided in front of the seat 110. With respect to the wheelchair 100 having such a configuration, the attachment part 10 of the wheelchair table 1 is attached to the lower part of one frame 112, and erecting the arm 20 places the table body 30 into an in-use position above the user's knees. The position of the table body 30 shown in FIG. 1 is the first in-use position in which, with the wheelchair 100 being placed on a level surface, the upper surface of the lid 38 is level. The wheelchair 100 is not particularly limited as long as it is configured such that a user can move around while sitting therein, and may be manually powered or electrically powered. Furthermore, the wheelchair 100 may be, for example, a chair on casters. Also, other than the frame, the place of attachment of the wheelchair table 1 to the wheelchair 100 can be the hanger bracket, arm rest, or the like of the wheelchair.

Figure 3:
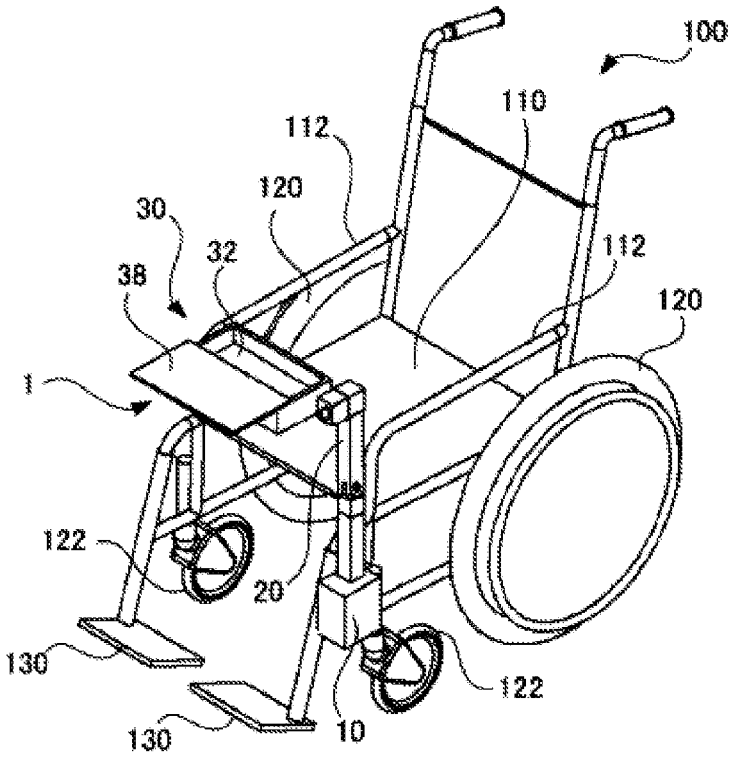
FIG. 3 is a perspective view showing a state during use of the wheelchair table shown in FIG. 2.

The lid 38 in the upper part of the table body 30, when slid forward, can open the mouth of the casing 32 as shown in FIG. 3, and user's personal effects (such as tablet information terminals, cell phones, wallets, and keys) can be accommodated in the casing 32. The upper surface of the lid 38, regardless of whether the lid is in an open or closed state, can be used as, for example, a work bench for a user or a surface on which personal effects of the user are placed.

Thus, attaching the wheelchair table 1 of this embodiment to the wheelchair 100 to form a storage compartment eliminates a need for a user to carry a bag. Therefore, there is no possibility that a bag placed on, for example, the lap gets in the way or falls when operating the wheelchair 100, thus making it easy for the user to concentrate on operation. Also, when work is performed using the table body 30, small items can be immediately stored in the casing 32 after the work is finished, and workability can be enhanced. A specific configuration of the casing 32 will be described in detail below.

Figure 4:
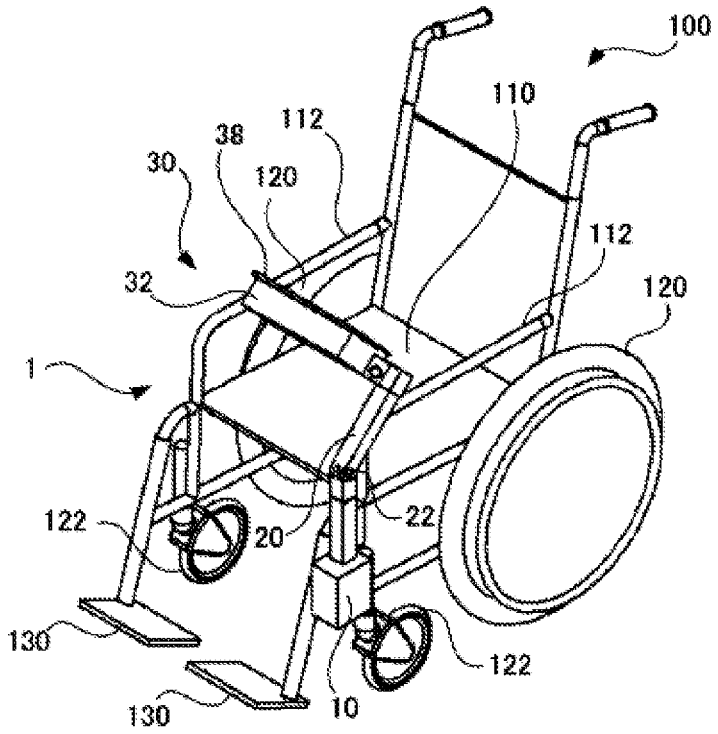
FIG. 4 is a perspective view showing another state during use of the wheelchair table shown in FIG. 2.
Figure 5:
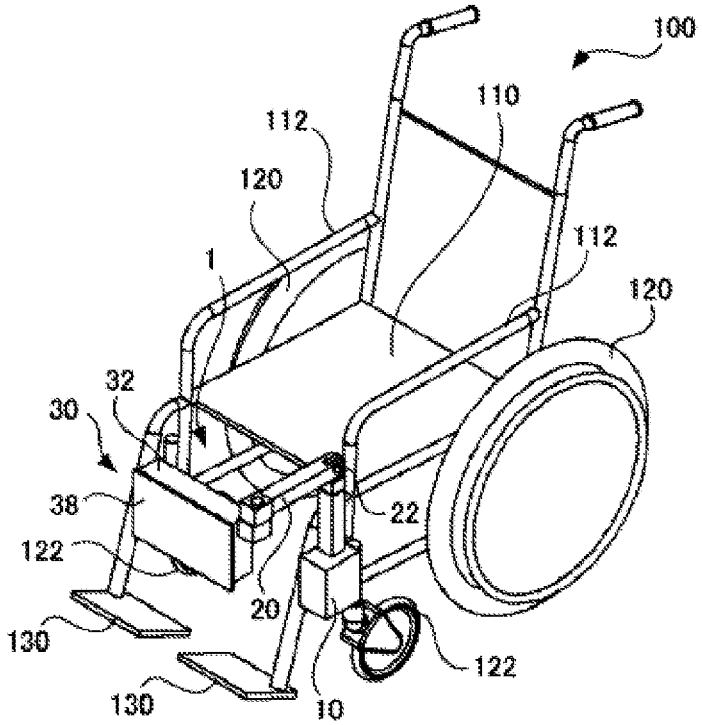
FIG. 5 is a perspective view showing yet another state during use of the wheelchair table shown in FIG. 2.

As shown in FIG. 4, the table body 30 can also be used in an in-use position in which the arm 20 is rotated further rearward (toward the user) on the rotating shaft 22 than the first in-use position shown in FIG. 1. The position of the table body 30 shown in FIG. 4 is the second in-use position in which, with the wheelchair 100 being placed on a level surface, the upper surface of the lid 38 is tilted toward the user. In this position, a user can use the table body 30 while leaning against the backrest of the seat 110, and workability can be enhanced. When not using the table body 30, the arm 20 is rotated forward on the rotating shaft 22 to move the table body 30 to a not in-use position that is in front of and below the user's knees, as shown in FIG. 5.

Figure 6:
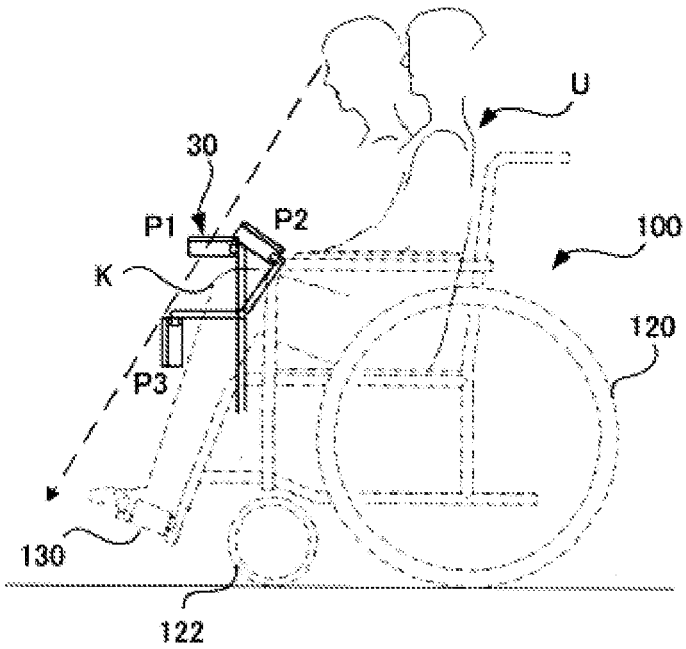
FIG. 6 is a side view showing a positional relationship of the table body and the user.

FIG. 6 is a side view showing the positional relationship of the table body 30 and a user U when the table body 30 is in a first in-use position P1, a second in-use position P2, and a not in-use position P3. As shown in FIG. 6, the first in-use position P1 and the second in-use position P2 are both located above knees K of the user U, and the not in-use position P3 is located in front of and below the knees K of the user U. When the table body 30 is moved to the not in-use position P3 from the first in-use position P1, the user, by leaning slightly forward, can see as far as the vicinity of the footrests 130 as indicated by the dashed arrow, and therefore the user can safely operate the wheelchair 100 while checking, for example, the unevenness of the road surface and the presence and absence of obstacles on the road surface. Moreover, since the table body 30 is not present above the user's knees, the user can concentrate on operation without having an oppressive feeling, and also the table body 30 can be prevented from getting in the way when the user sits at another table in, for example, a kitchen. The sight of the user's feet can also be secured by rotating the table body 30 from the first in-use position P1 to the second in-use position P2 when the length of the table body 30 in the longitudinal direction (fore-aft direction in the state during use) is short, and for example, when the user wishes to move a little while using the table body 30, such a rotating operation is convenient in some cases.

In consideration of the ease of securing sight during traveling as well as workability and storability, the size of the table body 30 is preferably 80 to 400 mm in the longitudinal direction (fore-aft direction) (more preferably 80 to 220 mm) and is preferably 80 to 600 mm in the transverse direction (right-left direction) (more preferably 80 to 450 mm and even more preferably 100 to 270 mm).

Figure 7:
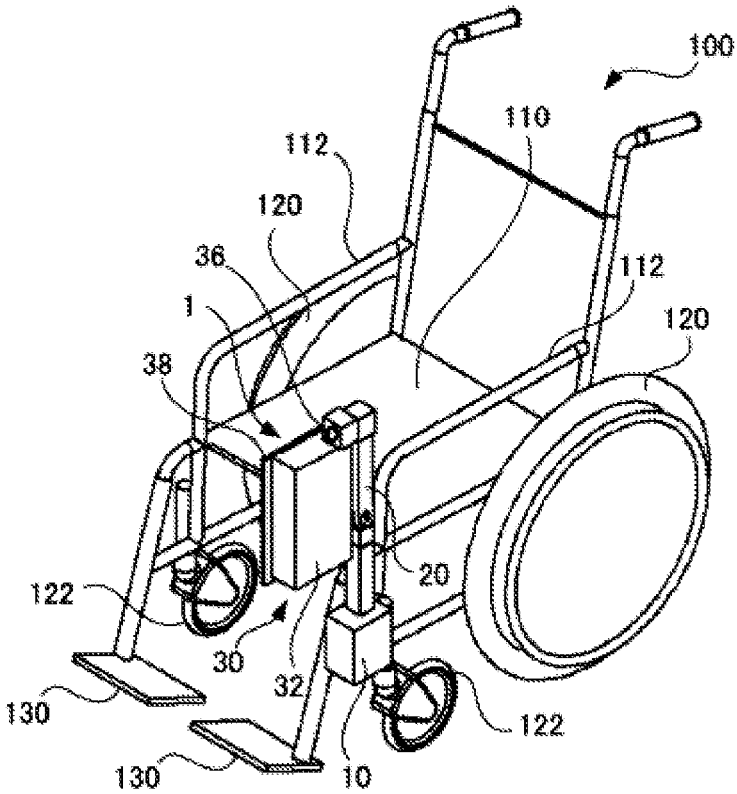
FIG. 7 is a perspective view showing yet another state during use of the wheelchair table shown in FIG. 2.
Figure 8:
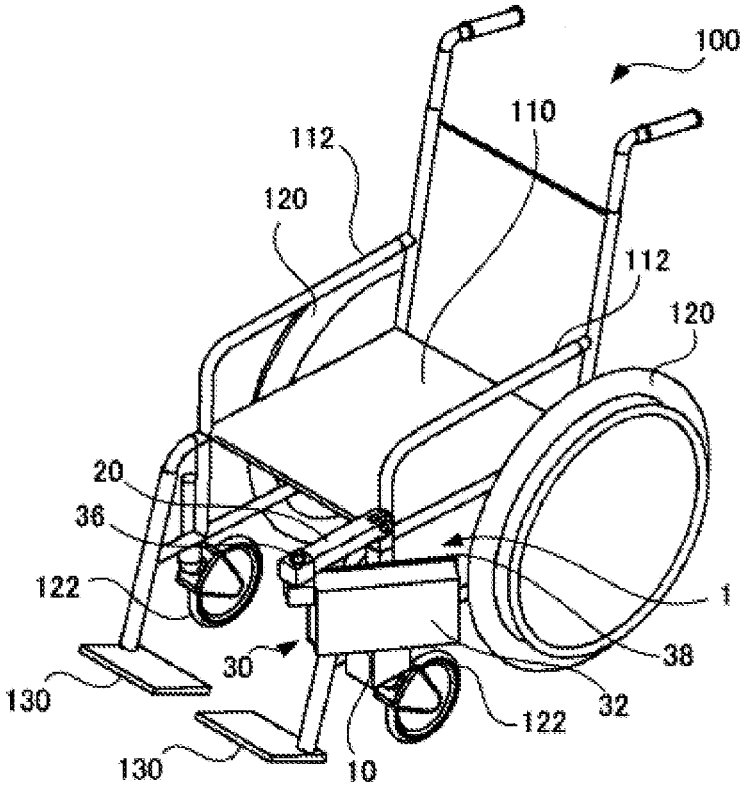
FIG. 8 is a perspective view showing yet another state during use of the wheelchair table shown in FIG. 2.

The table body 30 can also be moved by the rotational operation of the table body 30 relative to the arm 20 other than the rotational operation of the arm 20 relative to the attachment part 10 described above. The table body 30 shown in FIG. 7 shows a state reached from the state in which the table body 30 is in the first in-use position as shown in FIG. 1 by rotating the table body 30 downward on the rotating shaft 36 that is in the horizontal direction such that the table body 30 is first lifted up toward the side, and the table body 30 can be retreated to the side from above the user's knees. The table body 30 shown in FIG. 8 is in a state reached from the state in which the table body 30 is in the not in-use position as shown in FIG. 5 by rotating the table to the side on the rotating shaft 36 that is in the vertical direction, and the table body 30 can be retreated to the side from in front of and below the user's knees. In both states shown in FIGS. 7 and 8 as well, there is no possibility that the table body 30 gets in the way when a user gets in and out the wheelchair 100, and ease of use can be enhanced. In particular, the rotational movement of the table body 30 shown in FIG. 8 is performed along the horizontal plane with the rotating shaft 36 extending in the vertical direction, and therefore the arm 20 can support the weight of the table body 30 even when a large number of personal effects or the like are stored in the table body 30, and the user's burden can be reduced.

Figure 9:
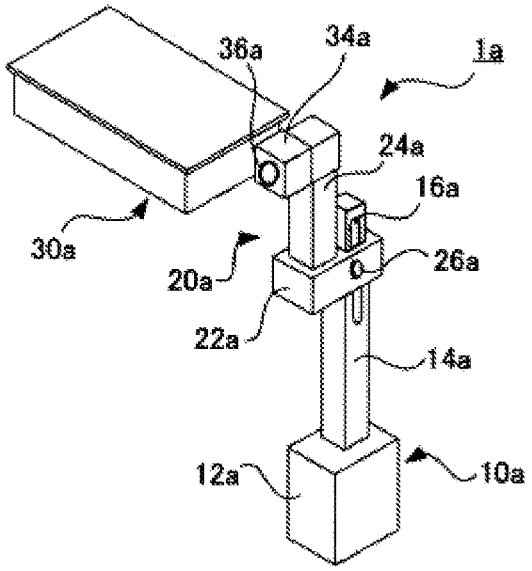
FIG. 9 is a perspective view of a wheelchair table according to the second embodiment of the present invention.
Figure 10:
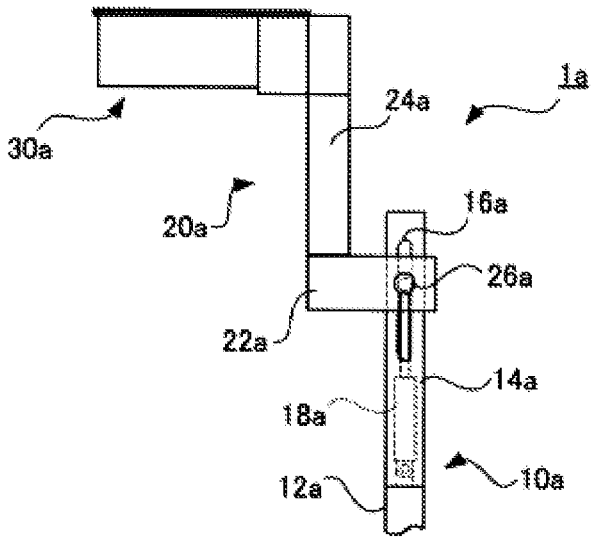
FIG. 10 is an outline perspective view showing relevant parts of the wheelchair table shown in FIG. 9.

FIG. 9 is a perspective view of the wheelchair table 1 according to the second embodiment of the present invention. FIG. 10 is a side view of relevant parts of the wheelchair table shown in FIG. 9. As shown in FIGS. 9 and 10, the wheelchair table 1*a* comprises an attachment part 10*a* to be attached to a wheelchair, an arm 20*a* supported by the attachment part 10*a*, and a table body 30*a* provided on the arm 20*a*.

As with the attachment part 10 shown in, for example, FIG. 1, the attachment part 10*a* comprises a main body 12*a* to be attached to, for example, the frame of a wheelchair, and a retaining part 14*a* extending upward from the main body 12*a*. In the retaining part 14*a*, a slit 16*a* is formed in the longitudinal direction.

The arm 20 comprises a support part 22*a* into which the retaining part 14*a* is inserted, an upstanding part 24*a* provided on the support part 22*a*, and a guide pin 26*a*. The table body 30*a* has the same configuration as the table body 30 shown in, for example, FIG. 1, and a mounting part 34*a* is rotatably attached to the tip part of the upstanding part 24*a* by a rotating shaft 36*a*. As shown in FIG. 10, the guide pin 26*a* is fixed to the support part 22*a*, and is supported by an elevating device 18*a* such as a gas spring or an electric cylinder that is provided inside the retaining part 14*a*. The elevating device 18*a* can raise or lower the arm 20*a* relative to the attachment part 10*a* by moving up or down the guide pin 26*a*.

Figure 11:
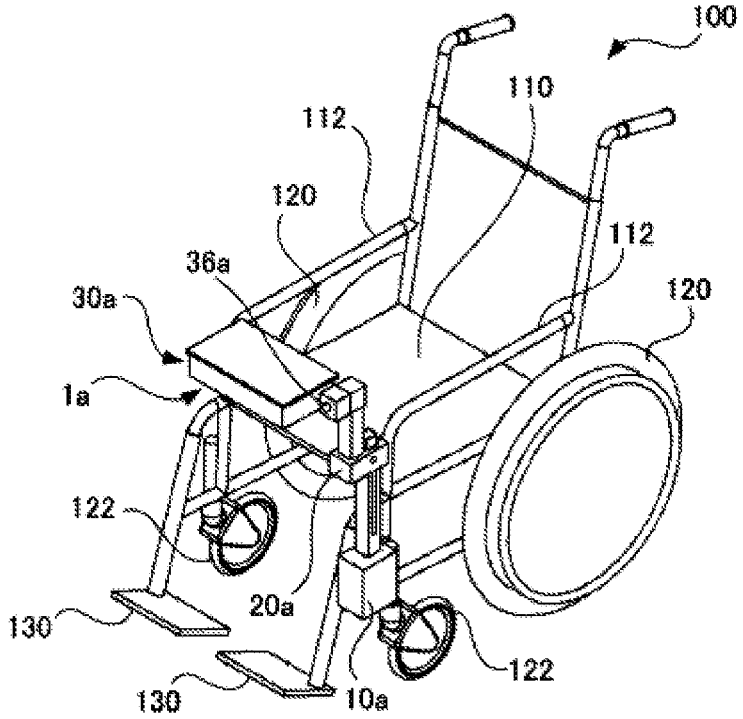
FIG. 11 is a perspective view showing a state in which the wheelchair table shown in FIG. 9 is attached to a wheelchair.
Figure 12:
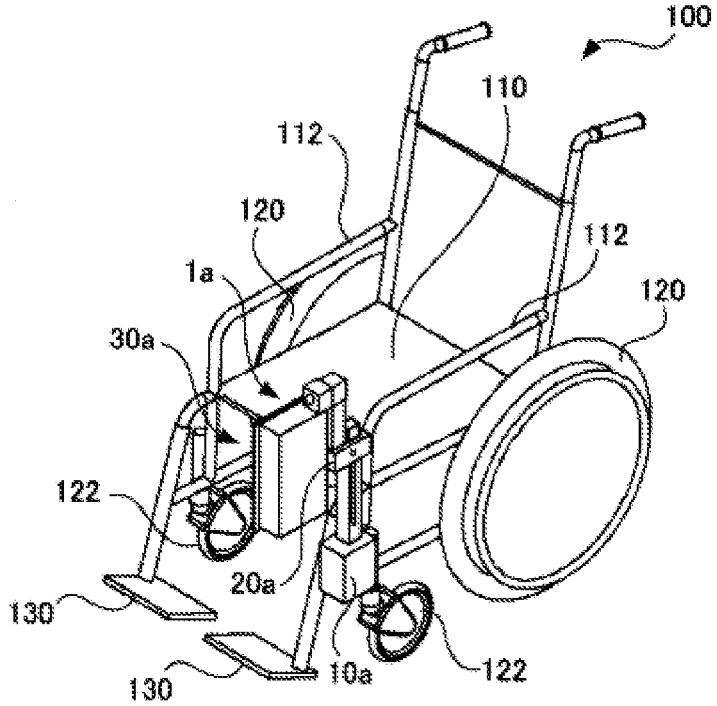
FIG. 12 is a perspective view showing a state during use of the wheelchair table shown in FIG. 11.
Figure 13:
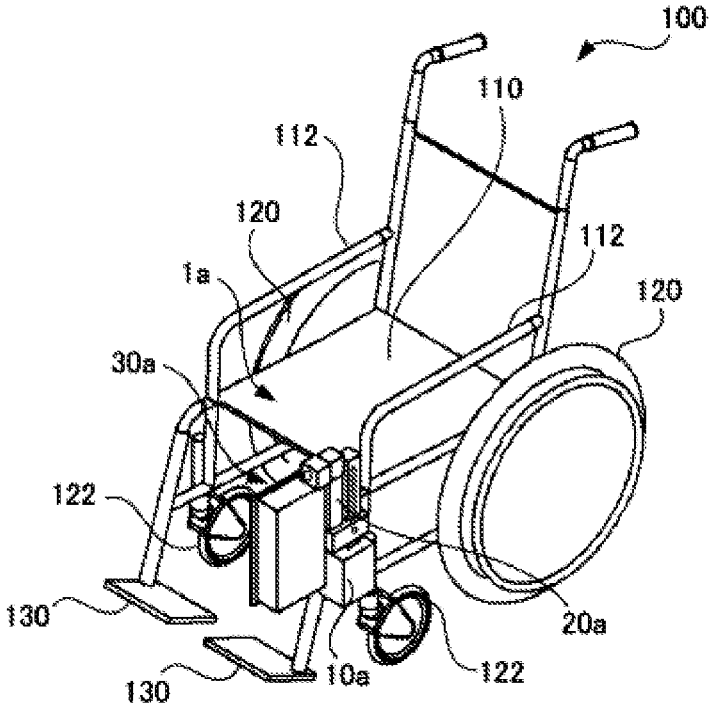
FIG. 13 is a perspective view showing another state during use of the wheelchair table shown in FIG. 11.

Attaching the wheelchair table 1*a* of the second embodiment to the wheelchair 100 as shown in FIG. 11 to place the table body 30*a* into an in-use position that is above the user's knees makes it possible to use the wheelchair table 1*a* in the same manner as the wheelchair table 1 shown in, for example, FIG. 2. Moreover, rotating the table body 30*a* relative to the arm 20*a* and then lowering the arm 20*a* relative to the attachment part 10*a* as shown in FIGS. 12 and 13 make it possible to move the table body 30*a* between the in-use position that is above the user's knees (the position shown in FIG. 11) and the not in-use position that is in front of and below the user's knees (the position shown in FIG. 13). Since the upward and downward movement of the arm 20*a* can be performed by the actuation of the elevating device 18*a*, operability can be enhanced.

Figure 14:
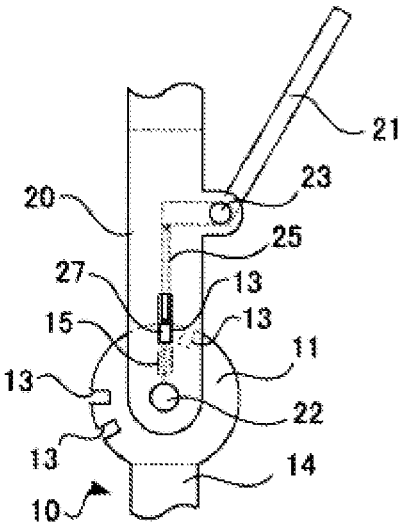
FIG. 14 is an enlarged view of relevant parts showing an example of the attachment structure for attaching the arm to the attachment part.

FIG. 14 is an enlarged view of relevant parts for explaining an example of the attachment structure for attaching the arm 20 to the attachment part 10 in the wheelchair table 1 shown in FIG. 1. A disc-like part 11 is formed in the upper part of the retaining part 14 of the attachment part 10, and a plurality of depressions 13 that serve as engagement parts are formed along the outer circumference of the disc-like part 11. On the other hand, inside the arm 20 a rod 25 is provided that moves back and forth in the longitudinal direction due to the operation of a lever 21, with a pivot shaft 23 serving as a fulcrum. A latch part 27 is provided at the tip of the rod 25. The latch part 27 is biased by a spring 15 composed of a coil spring so as to be accommodated in a depression 13, and the rotational position of the arm 20 relative to the attachment part 10 is fixed by the engagement of the latch part 27 and the depression 13. The spring 15 is not particularly limited to a coil spring as long as it biases the latch part 27 to be engaged with the depression 13, and may be another elastic body.

Figure 15:
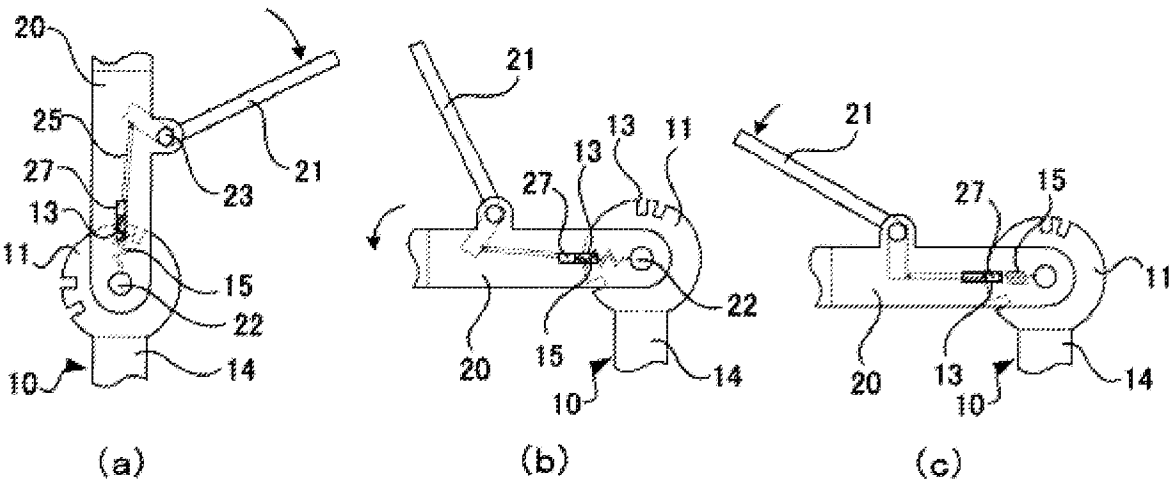
FIGS. 15(*a*) to 15(*c*) are drawings for explaining the operation of the attachment structure shown in FIG. 14.

According to the attachment structure shown in FIG. 14, as shown in FIG. 15(*a*), rotating the lever 21 in the direction indicated by the arrow causes the latch part 27 to move in the direction of leaving the depression 13 against the biasing force of the spring 15, and makes the arm 20 rotatable relative to the retaining part 14. In this state, rotating the arm 20 in the direction indicated by the arrow shown in FIG. 15(*b*) and then releasing the lever 21 cause, as shown in FIG. 15(*c*), the latch part 27 to be pulled back into the depression 13 due to the action of the spring 15 and the lever 21 to return in the direction indicated by the arrow, thus making the arm 20 unrotatable.

With the attachment structure shown in FIG. 14, pushing the lever 21 downward enables the arm 20 to be rotated, and therefore even in the case where a user does not have sufficient strength due to, for example, a physical disability, it is possible to initiate the rotation of the arm 20 using, for example, the weight of the upper half of the body and, without interruption, rotate and fix the arm 20 by operating only the lever 21. Moreover, providing a large number of depressions 13 with which the latch part 27 engages enables the arm 20 to rotate stepwise, thus making it possible for a user to fix the table body 30 to the desired rotational position.

Figure 16:
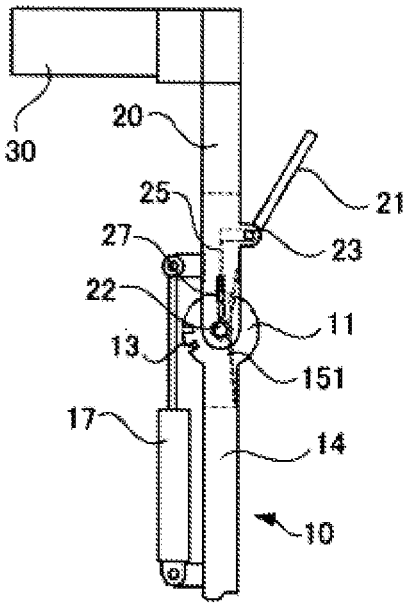
FIG. 16 is an enlarged view of relevant parts showing another example of the attachment structure shown in FIG. 14.

In order to prevent rapid movement of the table body 30, it is preferable that the configuration shown in FIG. 14 comprises a cushioning mechanism that can ease the rapid rotation of the arm 20. For example, as shown in FIG. 16, using a spring 151 that is composed of a torsion spring or the like and providing, for example, a damper 17 or a gas spring as a cushioning mechanism make it possible to safely and reliably rotate the table body 30 to the desired position.

Figure 17:
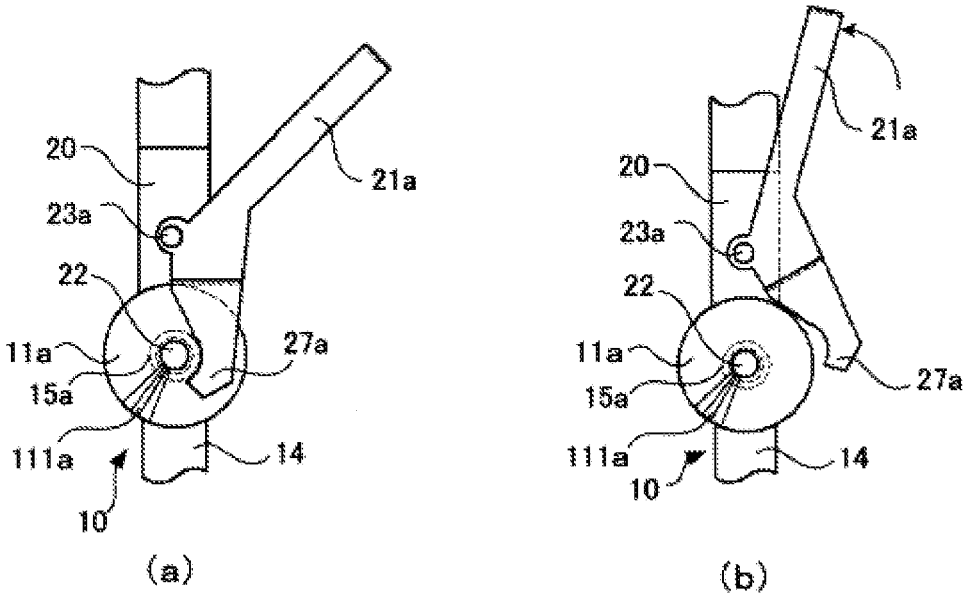
FIGS. 17(*a*) and 17(*b*) are enlarged views of relevant parts showing yet another example of the attachment structure shown in FIG. 14.

FIG. 17 is an enlarged view of relevant parts for explaining another example of the attachment structure for attaching the arm 20 to the attachment part 10 in the wheelchair table 1 shown in FIG. 1. In FIG. 17(*a*), a disc-like part 11*a* provided in the upper part of the retaining part 14 comprises a large number of grooves 111*a* (shown only partially in the figure) that are radially formed, with the rotating shaft 22 being the center. The engagement of a projecting engagement part 27*a* provided on the side opposite to the lever 21*a* and a groove 111*a* of the disc-like part 11*a*, with a pivot shaft 23*a* serving as a fulcrum, fixes the rotational position of the arm 20. Between the disc-like part 11*a* and the engagement part 27*a*, a spring 15*a* such as a coil spring for biasing both components to be tightly attached to each other is interposed, and thus the engagement of the engagement part 27*a* and the groove 111*a* is secured, thereby making it possible to fix the arm 20 to the desired rotational position. The engagement of the engagement part 27*a* and the groove 111*a* can be easily cancelled by operating the lever 21*a* in the direction indicated by the arrow shown in FIG. 17(*b*). The spring 15*a* can be configured to function such that the engagement part 27*a* and the groove 111*a* when not in an engaged state are biased so as to be separated in the direction of the rotating shaft 22, and the engagement part 27*a* is accommodated in a cover (not shown) and is tightly attached to the groove 111*a* when the engagement part 27*a* and the groove 111*a* engage.

Figure 18:
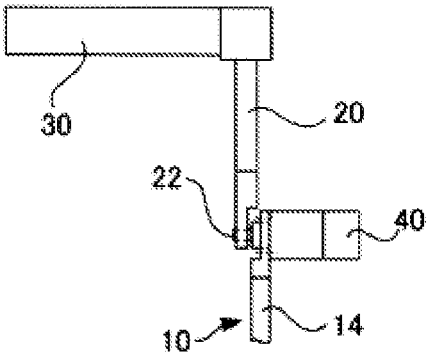
FIG. 18 is an enlarged view of relevant parts showing yet another example of the attachment structure shown in FIG. 14.

It is possible that the rotation and fixation of the arm 20 relative to the attachment part 10 are attained by a motor 40 that is directly coupled to the rotating shaft 22 as shown in FIG. 18, and operability for a user can be enhanced also in this way. The motor 40 is not particularly limited as long as it has a configuration that enables positional control, and examples include a geared motor, a stepping motor, and the like.

Figure 19:
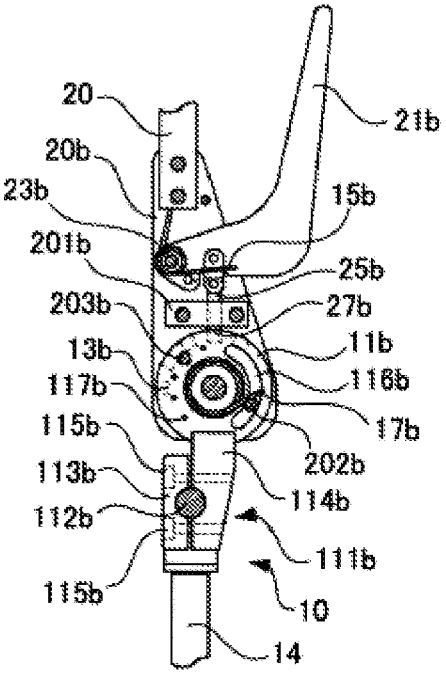
FIG. 19 is an enlarged view of relevant parts showing yet another example of the attachment structure shown in FIG. 14.

FIG. 19 is an enlarged view of relevant parts for explaining yet another example of the attachment structure for attaching the arm 20 to the attachment part 10 in the wheelchair table 1 shown in FIG. 1. In FIG. 19, a disc-like part 11*b* is provided in the upper part of the retaining part 14 via a rotating part 111*b*. The rotating part 111*b* has a configuration in which a rotating shaft 112*b* provided at the tip of the retaining part 14 is sandwiched between a pair of blocks 113*b* and 114*b*, and the disc-like part 11*b* is fixed to the block 114*b*. While the blocks 113*b* and 114*b* are fixed to the rotating shaft 112*b* by tightening bolts 115*b* and 115*b*, they become rotatable relative to the rotating shaft 112*b* by loosening the bolts 115*b* and 115*b*, thus making it possible to adjust the position, e.g., height position or inclination, of the disc-like part 11*b*.

A plurality of depressions 13*b* are formed along the outer circumference of the disc-like part 11*b*. On the other hand, in a support part 20*b* constituting the proximal end side of the arm 20, a rod 25*b* is provided that moves back and forth due to the operation of a lever 21*b*, with a pivot shaft 23*b* serving as a fulcrum. The support part 20*b* is provided with a guide part 201*b*, and the guide part 201*b* guides the rod 25*b* so as to move back and forth in the longitudinal direction of the arm 20. A latch part 27*b* is provided at the tip of the rod 25*b*. The latch part 27*b* is biased by a spring 15*b* composed of a torsion spring so as to be accommodated in a depression 13*b* that serves as an engagement part, and the rotational position of the arm 20 relative to the attachment part 10 is fixed by the engagement of the latch part 27*b* and the depression 13*b*.

In the side surface of the disc-like part 11*b*, an arc-shaped guide slit 116*b* is formed and, furthermore, a plurality of indentations 117*b* for indices are formed in the circumferential direction. The guide slit 116*b* and an indentation 117*b* engage with a projection 202*b* composed of a pin provided on the support part 20*b* and a projection 203*b* composed of a ball plunger, respectively, and thus the range of rotation of the arm 20 relative to the attachment part 10 is regulated and the rotational position is identified.

Figure 20:
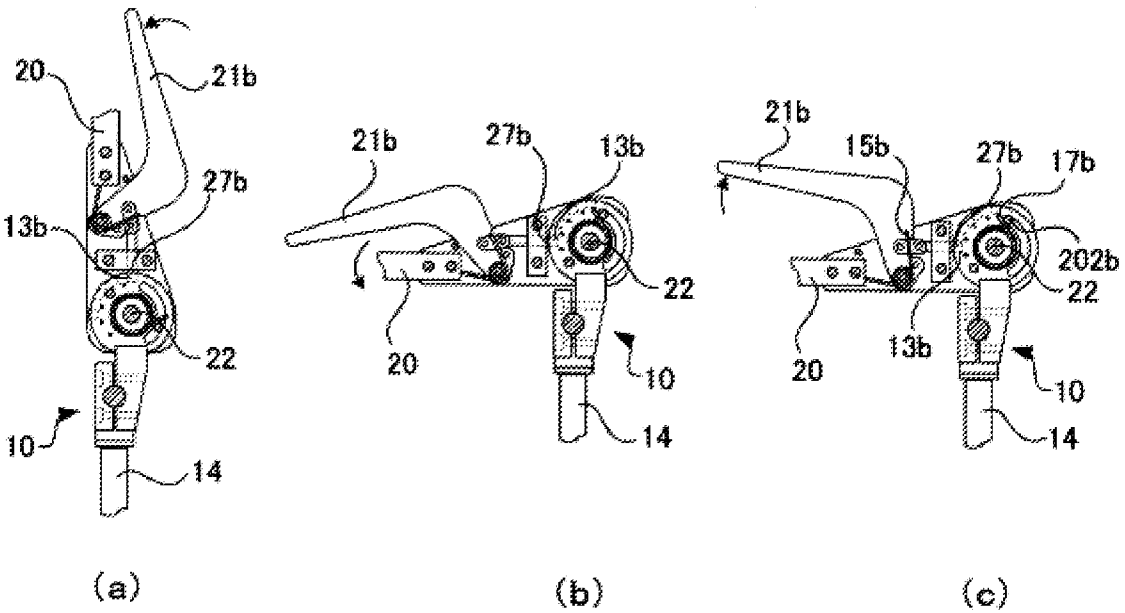
FIGS. 20(*a*) to 20(*c*) are drawings for explaining the operation of the attachment structure shown in FIG. 19.

In the attachment structure shown in FIG. 19, as shown in FIG. 20(*a*), rotating the lever 21*b* in the direction indicated by the arrow cancels the engagement of the latch part 27*b* and the depression 13*b*, and as shown in FIG. 20(*b*), the arm 20 can be rotated relative to the attachment part 10 in the direction indicated by the arrow to the desired rotational position. Then, releasing the lever 21*b* causes the lever 21*b* to return to the original rotational position due to the biasing force of the spring 15*b* such that the latch part 27*b* and the depression 13*b* engage as shown in FIG. 20(*c*), and the arm 20 is fixed. In this embodiment, a spring 17*b* such as a torsion spring is attached to the rotating shaft 22 so as to constitute a cushioning mechanism, and the engagement of the spring 17*b* with the projection 202*b* generates a biasing force that makes the rotational movement of the arm 20 subdued.

In the attachment structure shown in FIG. 19, the direction of rotation by pushing the lever 21*b* and the direction of rotation of the arm 20 match as indicated by the arrows in FIGS. 20(*a*) and 20(*b*), and therefore, by grasping the lever 21*b*, a user can easily rotate the arm 20 from an in-use position to a not in-use position. In the attachment structure shown in FIG. 19, torsion springs are used for the springs 15*b* and 17*b*, but other elastic bodies such as coil springs may be used, and the biasing force that acts may be any of compressive force and tensile force.

Figure 21:
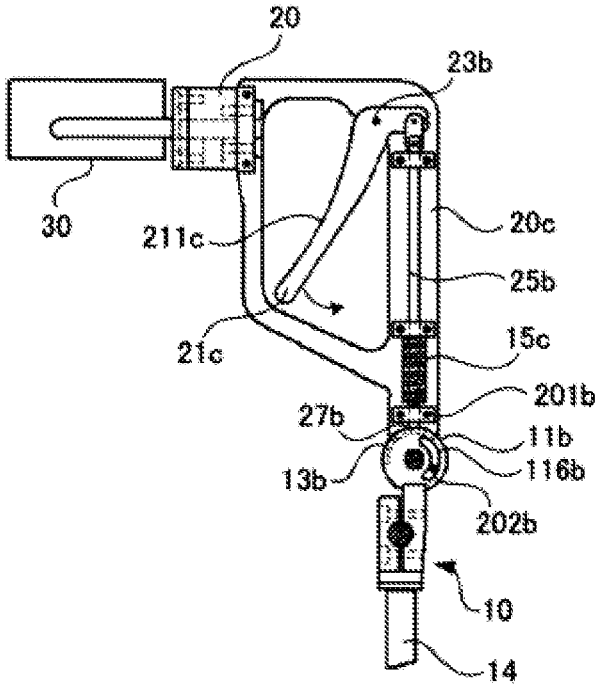
FIG. 21 is an enlarged view of relevant parts showing a modification of the attachment structure shown in FIG. 19.

FIG. 21 shows a modification of the attachment structure shown in FIG. 19, and the same components as in FIG. 19 are given the same reference numbers. In FIG. 21, the support part that serves as the proximal end side of the arm 20 is composed of a framework 20*c*, and a handle 211*c* of a lever 21*c* is placed within the framework 20*c*. The function of the lever 21*c* is the same as that of the lever 21*b* shown in FIG. 19, and grasping the framework 20*c* and the lever 21*c* in an integral manner causes the lever 21*c* to rotate in the direction indicated by the arrow against the biasing force of the spring 15*c* and makes the arm 20 rotatable relative to the attachment part 10. In the configuration shown in FIG. 21, a user can easily perform rotational operation of the lever 21*c* in all positions P1, P2, and P3 of the table body 30 shown in FIG. 6.

Figure 22:
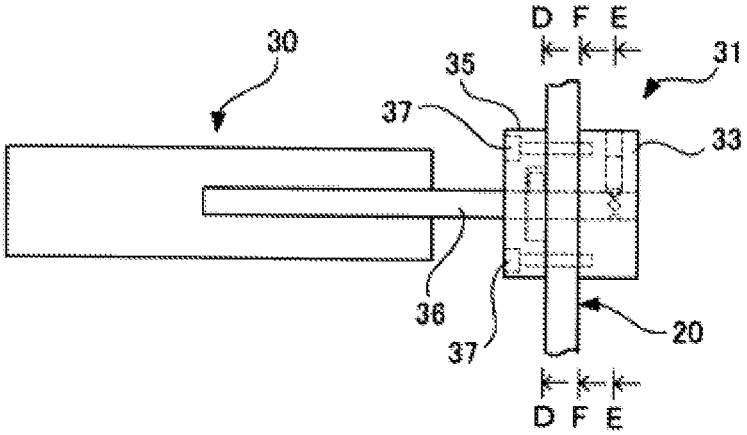
FIG. 22 is an enlarged view of relevant parts for explaining an example of the attachment structure for attaching the table body to an arm 20.

FIG. 22 is an enlarged view of relevant parts for explaining an example of the attachment structure for attaching the table body 30 to the arm 20 in the wheelchair table 1 shown in FIG. 1. The rotating shaft 36 for the arm 20 and the table body 30 has one end side that is fixed to the table body 30 and the other end side that is rotatably accommodated in a casing 31 fixed to the arm 20 by bolts 37 and 37. A cover 35 is attached to the casing 31 on the table body 30 side of a main body 33, and the arm 20 is sandwiched between the main body 33 and the cover 35. The position where the arm 20 is fixed to the casing 31 is not particularly limited, and the arm 20 can also be fixed to the end face of the main body 33.

Figure 23:
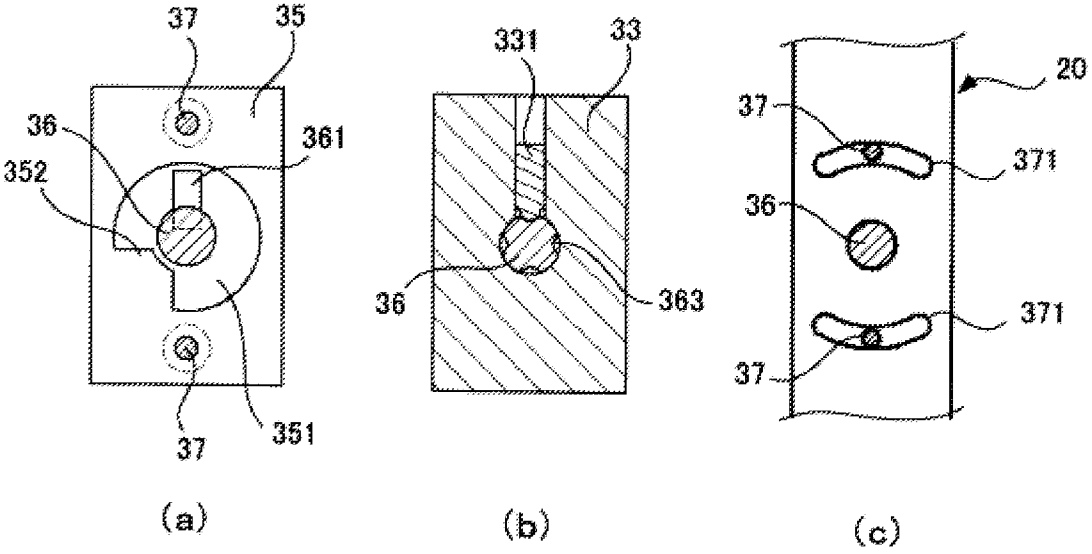
FIG. 23 includes drawings showing relevant parts of the attachment structure shown in FIG. 22, and FIG. 23(*a*) is a cross-sectional view taken along the line D-D, FIG. 23(*b*) is cross-sectional view taken along the line E-E, and FIG. 23(*c*) is cross-sectional view taken along the line F-F.

FIG. 23 shows relevant parts of the attachment structure shown in FIG. 22, FIG. 23(*a*) is a cross-sectional view taken along the line D-D of FIG. 22, FIG. 23(*b*) is a cross-sectional view taken along the line E-E of FIG. 22, and FIG. 23(*c*) is a cross-sectional view taken along the line F-F of FIG. 22. As shown in FIG. 23(*a*), the cover 35 comprises an accommodating recess 351 that has a protrusion 352 in a part of a circular depression, and an engagement projection 361 projecting from the outer circumferential surface of the rotating shaft 36 is accommodated in the accommodating recess 351. As shown in FIG. 23(*b*), a ball plunger 331 is provided inside the main body 33, and the ball part of the ball plunger 331 engages with any of the multiple indentations 363 formed in the circumferential direction of the rotating shaft 36. As shown in FIG. 23(*c*), the arm 20 has a plurality of arc-shaped elongated holes 371 and 371 into which bolts 37 and 37 are inserted on the respective sides of the part where the rotating shaft 36 penetrates, and thus the angle of attachment to the casing 31 (see FIG. 22) can be fine-tuned.

According to the attachment structure shown in FIGS. 22 and 23, the range of rotation of the rotating shaft 36 is regulated by the engagement of the engagement projection 361 and the accommodating groove 351, and the rotational position of the rotating shaft 36 is identified by the engagement of the ball plunger 331 and an indentation 363. The attachment structure for attaching the table body 30 to the arm 20 is not limited to the configuration shown in FIG. 22 and, for example, a configuration similar to the above-described attachment structure for attaching the arm 20 to the attachment part 10 is also applicable.

Figure 24:
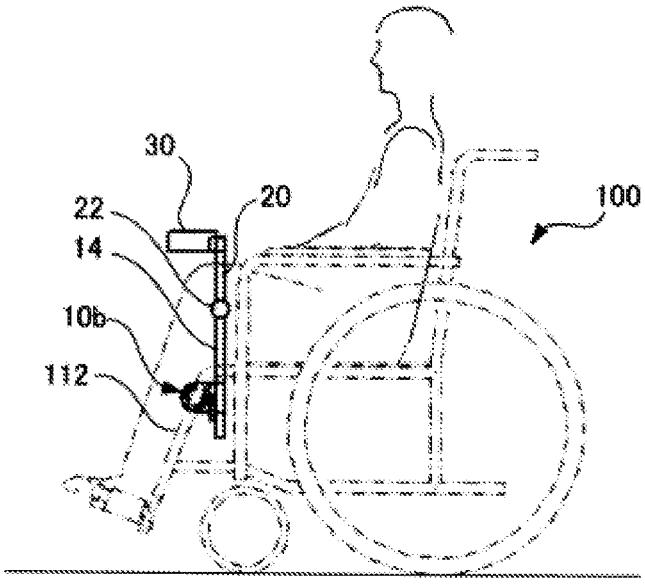
FIG. 24 is a side view showing an example of the attachment part.
Figure 25:
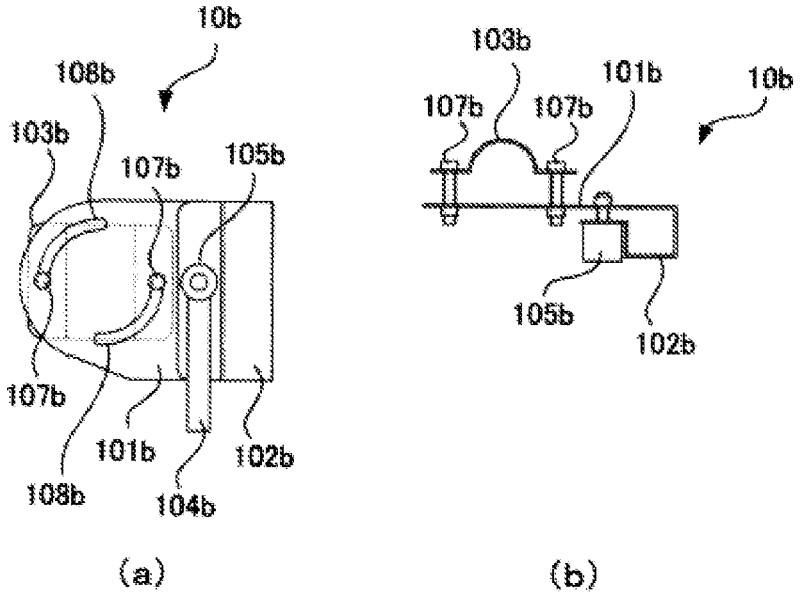
FIG. 25(*a*) is a side view, and FIG. 25(*b*) is a plan view, of the attachment part shown in FIG. 24.

FIG. 24 is a side view for explaining an example of the structure of the attachment part 10*b*, in the wheelchair table 1 shown in FIG. 1, to be attached to the frame 112 of the wheelchair 100. FIG. 25(*a*) is a side view of the attachment part 10*b*, and FIG. 25(*b*) is a plan view of the attachment part 10*b*. The attachment part 10*b* comprises a retaining-part attachment part 102*b* provided on one end side of the main body 101*b* and a frame attachment part 103*b* provided on the other end side of the main body 101*b*. The retaining-part attachment part 102*b* is formed by bending the end part of the main body 101*b*, and is fastened by a brace 105*b* that is equipped with a lever 104*b* so that the retaining part 14 can be fixed inside. The frame attachment part 103*b* is composed of a bracket that can sandwich the frame between the attachment part 103*b* and the main body 101*b* by fasteners 107*b* and 107*b*. The fasteners 107*b* and 107*b* are movable along arc-shaped guide slits 108*b* and 108*b* that are formed in the main body 101*b*, and can adjust the angle of attachment of the frame attachment part 103*b* to the main body 101*b*. Accordingly, irrespective of the inclination angle of the frame 112 shown in FIG. 24, the attachment part 10*b* can be reliably attached to the wheelchair 100, and versatility can be enhanced.

Figure 26:
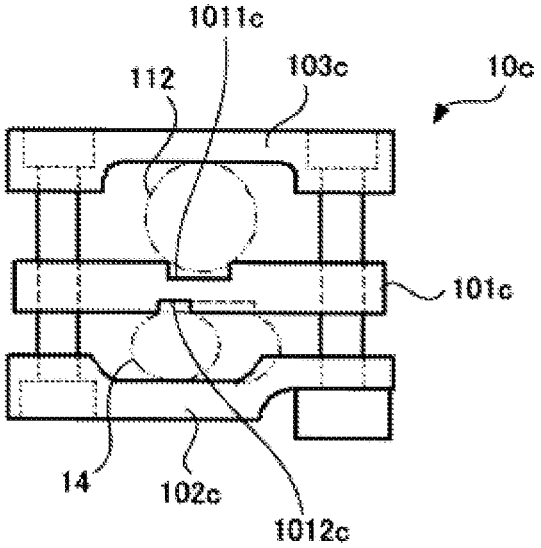
FIG. 26 is a plan view showing another example of the attachment part.

Various modifications can be made to the structure of the attachment part that is to be attached to the frame 112 of the wheelchair 100. For example, as shown in the plan view in FIG. 26, a retaining-part attachment part 102*c* and a frame attachment part 103*c* can be placed on the front surface side and the back surface side of a main body 101*c* of an attachment part 10*c*, respectively. The retaining part 14 can be sandwiched between the retaining-part attachment part 102*c* and the main body 101*c*, and the frame 112 can be sandwiched between the frame attachment part 103*c* and the main body 101*c*, using fasteners such as bolts in both cases. According to this configuration, the retaining part 14 can be adjacently placed on the side of the frame 112, and the retaining part 14 can be reliably supported in an upright state. Retaining grooves 1011*c* and 1012*c* extending along the retaining part 14 and the frame 112 are formed in the front and rear surfaces of the main body 101*c*, respectively. The retaining grooves 1011*c* and 1012*c* are inclined relative to each other so as to support the retaining part 14 in the vertical direction when the attachment part 10*c* is attached to the inclined frame 112.

Figure 27:
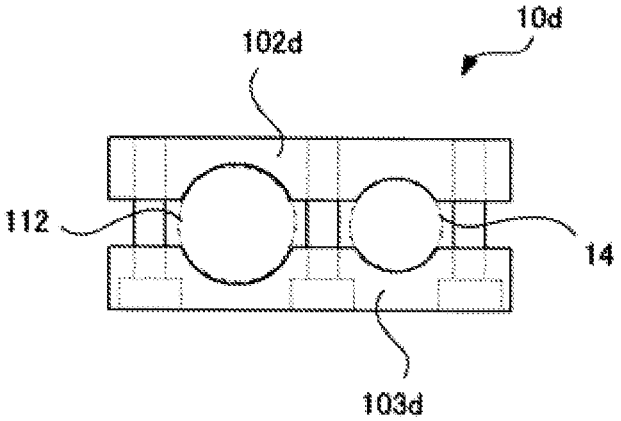
FIG. 27 is a plan view showing yet another example of the attachment part.

Moreover, as shown in FIG. 27, an attachment part 10*d* may be configured to simply sandwich the retaining part 14 and the frame 112 between two blocks 102*d* and 103*d*, and the number of components can be reduced.

The table body 30 shown in FIG. 3 is configured to allow the opening and closing of the storage space with the lid 38 that slides across the opening of the casing 32. Various modifications can be made to the attachment structure for attaching the lid 38 to the casing 32, and examples include a configuration in which the lid 38 slides across the opening of the casing 32, with a corner of the casing 32 serving as a hub, a configuration in which the lid 38 is rotated, with one side of the casing 32 serving as a pivot shaft, a configuration in which the lid 38 is formed into a tubular shape and the casing 32 is moved in and out, a configuration in which the lid 38 is opened and closed by a parallel link, and similar configurations. In the case where the casing 32 is accommodated in the lid 38 that is in a tubular shape, the casing 32 can be divided into multiple portions. It is preferable that the lid 38 can maintain the casing 32 in a closed state by a magnet, metal brace, band, zipper, or the like such that items accommodated inside the casing 32 do not scatter around due to the rotation of the arm 20 or the table body 30. In the table body 30 shown in FIG. 3, the casing 32 is attached to the arm 20, but the table body 30 may be configured such that the lid 38 that has high rigidity and strength is attached to the arm 20, and the casing 32 is moved relative to the lid 38.

Figure 28:
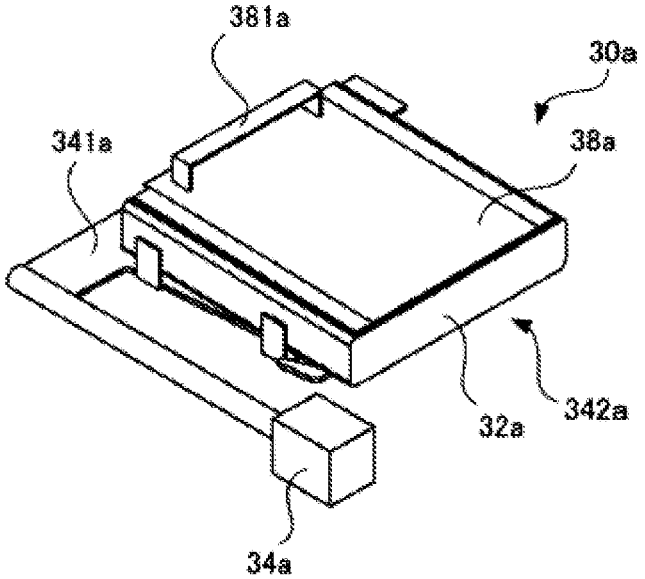
FIG. 28 is a perspective view showing an example of the table body.

FIG. 28 is a perspective view showing a preferable example of the table body 30*a*. The table body 30*a* comprises a base part 341*a* fixed to the mounting part 34*a* for attachment to the arm (not shown) and a receptacle 342*a* the lower surface of which is supported by the base part 341*a*. The receptacle 342*a* is composed of, for example, synthetic resin or cloth, and the upper part of the casing 32*a* having storage space is covered by a lid 38*a*. The lid 38*a* comprises a handle 381*a*, and the lid 38*a* can be opened and closed by holding the handle 381*a*. With the casing 32*a* in a closed state, the lid 38*a* can be fixed to the casing 32*a* by a magnet or the like.

The receptacle 342*a* comprises an engagement member (not shown) such as an elastic band or a belt, and is configured to be attachable to and detachable from the base part 341*a* by engaging and disengaging this engagement member with the base part 341. In order to reliably prevent the receptacle 342*a* from falling off the base part 341*a* when the table body 30*a* is rotated, a fastener such as a buckle, swivel, or magnet can be suitably used. It is preferable that the base part 341*a* has high rigidity and strength, and even when the receptacle 342*a* is composed of a flexible material such as cloth or resin sheet, widely opening the lid 38*a* makes it possible to do work on the base part 341*a* via the bottom part of the receptacle 342*a*.

Figure 29:
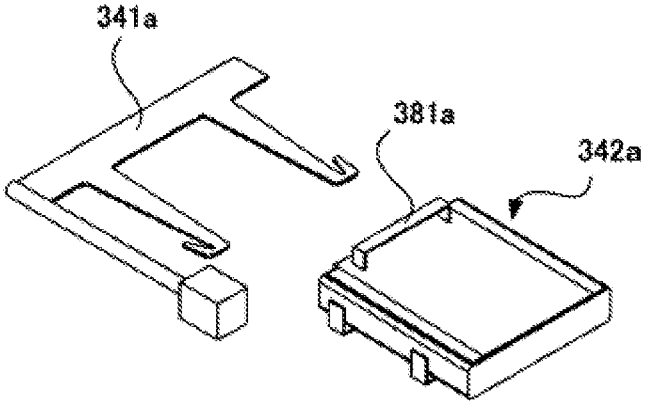
FIG. 29 is a perspective view for explaining a state during use of the table body shown in FIG. 28.

According to the table body 30*a* shown in FIG. 28, the lower surface of the receptacle 342*a* can be supported by the base part 341*a*, and therefore the receptacle 342*a* even when it has a large size can be reliably supported, and the storage space and the work space can be increased. Moreover, when getting off the wheelchair, the receptacle 342*a* can be removed from the base part 341 as shown in FIG. 29, and it can be carried like a bag by, for example, holding the handle 381*a*. With a conventional wheelchair, a user needs to place a bag on the lap, under the seat, or in a side part, rear part, or similar place of the wheelchair, and therefore operability and workability are impaired, but the use of the receptacle 342*a* of this embodiment in place of a bag can enhance the operability and workability of the wheelchair.

REFERENCE SIGNS LIST

1. Wheelchair table
10. Attachment part
20. Arm
22. Rotating shaft
30. Table body
36. Rotating shaft
100. Wheelchair

The invention claimed is:

1. A wheelchair table comprising:
an attachment part configured to be attached to a side part of a wheelchair;
an arm supported by the attachment part; and
a table body provided at a tip part of the arm;
wherein the arm is supported so as to be rotatable in upward and downward directions relative to the attachment part such that the table body can be lowered from at least one in-use position located above a user's knees to a not in-use position located in front of and below the knees while the user sits in the wheelchair;
wherein the arm includes
a latch part configured to engage an engagement part of the attachment part,
a spring configured to bias the latch part to engage with the engagement part, and
a lever configured to detach the latch part against a biasing force of the spring;
wherein the arm is configured to rotate relative to the attachment part when the lever is rotated by applying a pushing force to the lever to counter the engagement between the engagement part and the latch part; and
wherein a direction of rotation of the lever matches a rotational direction of the arm.

2. The wheelchair table according to claim 1, wherein the arm further comprises:
a framework configured to rotatably support the lever, the lever including a handle within the framework.

3. The wheelchair table according to claim 1, further comprising:
a cushioning mechanism configured to ease rapid rotational movement of the arm relative to the attachment part.

4. The wheelchair table according to claim 1, wherein the at least one in-use position of the table body comprises:
a first in-use position in which an upper surface of the table body is level; and
a second in-use position in which the upper surface of the table body is tilted toward the user's side.

5. The wheelchair table according to claim 1, wherein
the table body is rotatably attached to the arm; and
the table body is configured to be retracted to a side from above the knees or from in front of and below the knees of the user.

6. The wheelchair table according to claim 1, wherein the table body comprises:
a base part supported by the arm; and
a receptacle configured to be attached to and detached from the base part, wherein
the receptacle is configured to be carried once removed from the base part.

7. A wheelchair in which the wheelchair table of claim 1 is attached to a side part.

* * * * *